US005445173A

United States Patent [19]

Aiken

[11] Patent Number: 5,445,173

[45] Date of Patent: Aug. 29, 1995

[54] SYSTEM FOR STIRRING AND THEREBY REDUCING BUILD UP OF BOTTOM SEDIMENTS IN A STORAGE TANK

[75] Inventor: William B. Aiken, Houston, Tex.

[73] Assignee: Matrix Service, Inc., Tulsa, Okla.

[21] Appl. No.: 276,270

[22] Filed: Jul. 18, 1994

[51] Int. Cl.[6] ..... B08B 9/12

[52] U.S. Cl. ..... 134/167 R; 134/181; 239/263

[58] Field of Search ..... 134/167 R, 168 R, 181; 118/317; 239/263, 263.1

[56] References Cited

U.S. PATENT DOCUMENTS

| | | | |
|---|---|---|---|
| 1,978,015 | 10/1934 | Erdman | 210/209 |
| 2,116,935 | 5/1938 | Richard et al. . | |
| 2,647,639 | 8/1953 | Grein | 210/207 |
| 2,714,080 | 7/1955 | Kennedy, Jr. et al. | 134/181 X |
| 2,991,203 | 7/1961 | In 'T Veld et al. | 134/24 |
| 3,052,574 | 9/1962 | Kennedy, Jr. | 134/167 R X |
| 3,121,027 | 2/1964 | Galanor | 134/10 |
| 3,402,725 | 9/1968 | Booth | 134/167 R |
| 3,408,006 | 10/1968 | Stanwood | 239/66 |
| 3,449,772 | 6/1969 | Werner | 4/172 |
| 3,523,647 | 8/1970 | Radecki | 239/206 |
| 3,542,207 | 11/1970 | Stansmore | 210/520 |
| 3,544,012 | 12/1970 | McNally | 239/227 |
| 3,586,294 | 6/1971 | Strong . | |
| 3,675,252 | 7/1972 | Ghiz | 4/172.17 |
| 3,704,789 | 12/1972 | Jablon et al. | 210/531 |
| 3,878,857 | 4/1975 | Heibo | 134/167 R |
| 3,895,756 | 7/1975 | Jaeger | 239/277 |
| 3,953,226 | 4/1976 | Emond et al. | 134/104 |
| 3,981,315 | 9/1976 | Olthoff | 134/167 R |
| 4,347,979 | 9/1982 | Mathews | 239/206 |
| 4,407,678 | 10/1983 | Furness et al. | 134/167 R |
| 4,685,974 | 8/1987 | Furness et al. | 134/22.18 |
| 4,945,933 | 8/1990 | Krajicek et al. | 134/167 R |
| 5,078,799 | 1/1992 | Matter et al. | 134/22.18 |
| 5,091,016 | 2/1992 | Krajicek et al. | 134/22.1 |
| 5,107,873 | 4/1992 | Clinger | 134/167 R X |
| 5,138,741 | 8/1992 | Allen | 15/340.1 |
| 5,269,041 | 12/1993 | Allen | 15/340.1 |

*Primary Examiner*—Philip R. Coe
*Attorney, Agent, or Firm*—Head & Johnson

[57] ABSTRACT

A system is provided for stirring and thereby reducing build up of bottom sediments in a storage tank, the system including a vertical outer casing having an intermediate opening communicating with a horizontal tubular member so that the vertical outer casing is supported within the interior of the tank and above the tank bottom. A perforated inner casing is rotatably supported within the vertical outer casing. An elbow fitting is affixed to one end of the inner casing. A nozzle is affixed to the elbow having an outlet directed to horizontally discharge fluid over the tank bottom. A stepping motor is secured to the outer casing and has an output shaft affixed to the inner casing by which the inner casing is rotated to discharge recirculated tank fluid over the tank bottom to stir up and suspend bottom sediments.

14 Claims, 7 Drawing Sheets

SYSTEM FOR STIRRING AND THEREBY REDUCING BUILD UP OF BOTTOM SEDIMENTS IN A STORAGE TANK

CROSS-REFERENCE TO RELATED APPLICATIONS

This application is not related to any pending United States or foreign patent applications.

CROSS-REFERENCE TO MICROFICHE APPENDIX

This application is not related to any microfiche appendix.

BACKGROUND OF THE INVENTION

When liquids are stored in tanks, any entrained solid components can drop out, this is a particular problem with crude oil since crude oil inevitably includes entrained solid components, such as sand or silt, that are removed from the subterranean oil reducing formation as the oil flows or is pumped to the earth's surface. When crude oil is stored in a tank, it normally sits in a relatively still, dormant state for a long period of time. Gravity pulls the solid particles down and over time creates a layer of sludge on the tank bottom. If not stirred so that the sludge is re-suspended into the tank fluid, the sludge is not removed as the crude oil is removed from the tank and will continually build up on the tank bottom and become a serious problem.

The accumulation of sludge on the bottom of a crude oil storage tank can cause a number of operational problems. One serious problem is that the capacity of the storage tank is reduced. Another example is as various layers of sludge deposits form, they may entrap pools of water which later form hydrates or water slugs in the outflow from the tank. When a tank employs a floating roof, a common expedient in tank storage technology, the floating roof typically has legs which limits the downward travel of the floating roof as fluid is removed from the tank. Sludge can cause uneven landing of the legs. Another problem is that when sludge builds up as a consequence of storage of crude oil, it may interfere with the use of the tank for storage of a different type of fluid product.

For all of these reasons, sludge accumulated during normal operations of a storage tank must be removed. If it is not removed by re-suspending the sludge or bottom sediments in the tank fluids so that it is removed as a normal consequence of the outflow of the tank fluid, it is sometimes necessary to physically remove it. This is a costly problem since it is a hazardous occupation for workmen to enter into the interior of a tank to assist in the physical removal of sludge. Further, the disposal of large amounts of accumulated sludge becomes an environmental problem and, therefore, an expense to the operator.

For this reason, it has been a practice of the operators of storage tanks and particularly crude oil storage tanks, to employ systems that recirculate tank fluid through a jet system, the jet serving to discharge tank fluid at high velocity over the tank bottom to cause the sediments to be re-suspended in the fluid. An example of a sludge removal machine of this type is illustrated in U.S. Pat. No. 4,407,678 entitled "Sludge Removal Machine" that issued Oct. 4, 1983. The machine described in this patent provides oppositely directed nozzles and is an example of previously existing efforts to which the present invention is directed as an improvement. For further background information to various tank cleaning devices, reference may be had to the following previously issued U.S. Pats.:

| Title | U.S. Pat. No. |
|---|---|
| Apparatus and Method of Cleaning Tanks Containing Fluid | 1,978,015 |
| Apparatus For Cleaning Tanks and The like | 2,116,935 |
| Apparatus For Cleaning Tanks and The like | 2,647,639 |
| Method and Apparatus For Cleaning The Interior Of A Tank | 2,991,203 |
| Tank Washing System | 3,121,027 |
| Liquid Jet Producing Device | 3,408,006 |
| Automatically Cycling Swimming Pool Cleaning System | 3,449,772 |
| Part Circle Water Motor Driven Sprinkler | 3,523,647 |
| Sedimentation Tank With Rotary Sediment Raking Structure | 3,542,207 |
| Pressure Jet Tank Cleaner | 3,544,012 |
| Method and Apparatus For Creating A Suspension of Fine Particles In A Liquid | 3,586,294 |
| Pop-Up Head For Water Jet-Pool Cleaning System | 3,675,252 |
| Continuous Sedimentation Tank With Center-Pier Supported Sediment Raking Apparatus | 3,704,789 |
| Apparatus For Cleaning Tanks And The Like | 3,878,857 |
| Method and Apparatus For Cleaning Vessels | 3,895,756 |
| Tank Cleaning Apparatus | 3,953,226 |
| Swimming Pool Cleaner | 4,347,979 |
| Sludge Removal Machine | 4,407,678 |
| Method For Cleaning Settled Sludge | 4,685,974 |
| Liquid Circulator Useful For Dispersing Sediment Contained In A Storage Tank | 4,945,933 |
| Process For Recovering Crude Oil Or Refinery Products From Sludgy, Thickened or Sedimented Products | 5,078,799 |
| Method For Dispersing Sediment Contained In A Storage Tank | 5,091,016 |
| Remote Controlled Sludge Removal System | 5,138,741 |
| Remote Controlled Sludge Removal Apparatus | 5,269,041 |

BRIEF SUMMARY OF THE INVENTION

This invention provides a system for stirring and thereby reducing build up of bottom sediments in a storage tank, such as a crude oil storage tank. Basically, bottom sediments in a storage tank are caused to be dislodged and re-suspended in the liquid within the tank, such as crude oil, so that as the crude oil is withdrawn from the tank in the normal course of use, the re-suspended bottom sediments can also be withdrawn. The device functions by providing a flow of recirculated tank fluid that is directed by a jet over the interior of the bottom of the tank to dislodge and re-suspend the sediments. The apparatus of the invention is in two basic forms. In one form, the apparatus that supports a jet for discharge of recirculated fluid can be completely suspended from a plate affixed to a flange outlet in the sidewall of the tank. This means that the entire structure can be installed and/or removed without the necessity of workmen entering into the interior of the tank. In another embodiment, the device is supported near the center of a cylindrical tank so that it can sweep in a full 360° arc during a tank cleaning operation.

Whether suspended from the tank wall or supported from the tank bottom, a horizontal tubular member is supported within the tank and spaced above the tank bottom. The horizontal tubular member has an inner end and an outer end that communicates with the exterior of the tank.

A vertical outer casing has an intermediate opening that communicates with the horizontal tubular member at its inner end. Rotatably positioned within the interior of the vertical outer casing is a perforated inner casing. An elbow fitting is affixed at one end of the inner casing, that is, either at the upper end or lower end. Attached to the elbow fitting is a nozzle. Affixed to the outer casing at the end thereof opposite the elbow fitting and nozzle is a stepping motor having an output shaft. The output shaft of the stepping motor is connected to the perforated inner casing. The stepping motor may be either electrically or hydraulically actuated. A hydraulically actuated stepping motor is preferred since it does not require any electrical conductors or connections interiorly of the storage tank and thereby reduces the possibility of explosions within the tank. When the stepping motor is hydraulically actuated, two hydraulic conductors extend from the stepping motor to the exterior of the tank.

On the exterior of the tank there is positioned a pump and motor used for recycling liquid from the interior of the tank through the horizontal tubular member, through the vertical outer casing, through the perforated inner casing and through the elbow fitting and nozzle to form a jet of recirculated fluid that is ejected substantially parallel and/or close to the tank bottom to cause turbulence in the fluid within the tank to dislodge and re-suspend bottom sediments. An outlet pipe is provided between the interior and the exterior of the tank thereof as a means of drawing liquid out of the tank. The withdrawn liquid is passed through a pump exterior of the tank by which the tank fluid is recirculated. The liquid outlet may be in the form of an open ended pipe that can be suspended by the same plate that holds a wall mounted nozzle support system and, in like manner, the outlet pipe can be made a part of the arrangement for passing fluid into the horizontal support member when the nozzle system is supported on the tank bottom. By means of a hydraulic system mounted exterior of the tank, the control of hydraulic fluid to the stepping motor can be carefully and accurately controlled to cause the stepping motor to step in increments. The amount of each increment can be selected by the hydraulic control system as well as the duration, the hydraulic control system employing electrically operated directional control valves and pressure actuated switches that are connected to an electrical control circuit. In this manner, the system is adapted to enable the operator to fully control all parameters of the system so that the operator can select the time of starting and stopping a bottom sediment removal process, as well as the manner in which the bottom sediment removal process is conducted, that is, the quantity of tank fluid that is recirculated, the time of starting and stopping recirculation system, the degree of incremental movement of the nozzle, and the length of time the nozzle is in each incremental position—all according to the size of the tank, the characteristic of the liquid contained in the tank and the quantity of bottom sediments existing at the time the sediment removal process is initiated.

A better understanding of the invention will be obtained from the following description and claims taken in conjunction with the attached drawings.

DESCRIPTION OF THE DRAWINGS

FIG. 6 shows the parallel relationship between the horizontal tubular member that supports the nozzle actuating portion of the system as it is arranged in parallel relationship with the fluid outlet piping by which tank fluid is drawn from out of the tank for recirculation.

DESCRIPTION OF THE PREFERRED EMBODIMENTS

Figure 1:
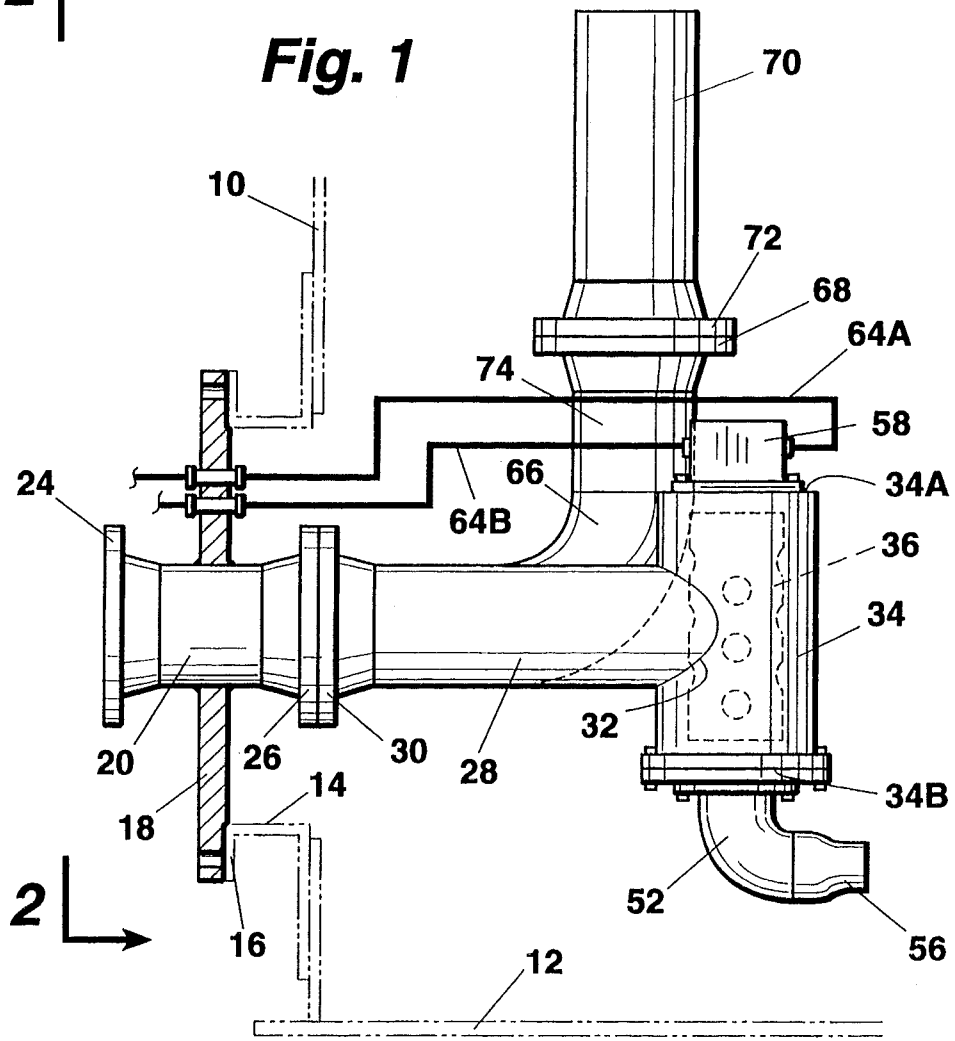
FIG. 1 is an elevational side view of a portion of the system for stirring and thereby reducing build up of bottom sediments in a storage tank showing the mechanism as mounted within the tank. A small portion of a tank is shown in dotted outline showing a manhole in the tank and a plate secured to the manhole by which the portions of the system that are interior of the tank can be supported above the tank floor.

Referring to the drawings and first to FIGS. 1 through 6, the basic structure for practicing the invention is illustrated. FIG. 1 illustrates a small section of a typically large diameter fluid storage tank, such as a crude oil storage tank. The tank has a cylindrical sidewall 10 and a horizontal bottom 12 and has a relatively large diameter opening 14 in sidewall 10 terminating at flange 16. Opening 14 is sometimes referred to as a "manhole" since openings of this size afford the possibility of entry and exit of workmen. Affixed to tank flange 16 is a cylindrical plate 18. In the embodiment of the invention illustrated in FIGS. 1–6 and 8–10, the entire mechanism that is positioned within the interior of tank 10 is supported to plate 18. FIG. 11, which will be discussed subsequently, shows an alternate embodiment wherein the employment of a large manhole plate 18 is not required.

Figure 6:
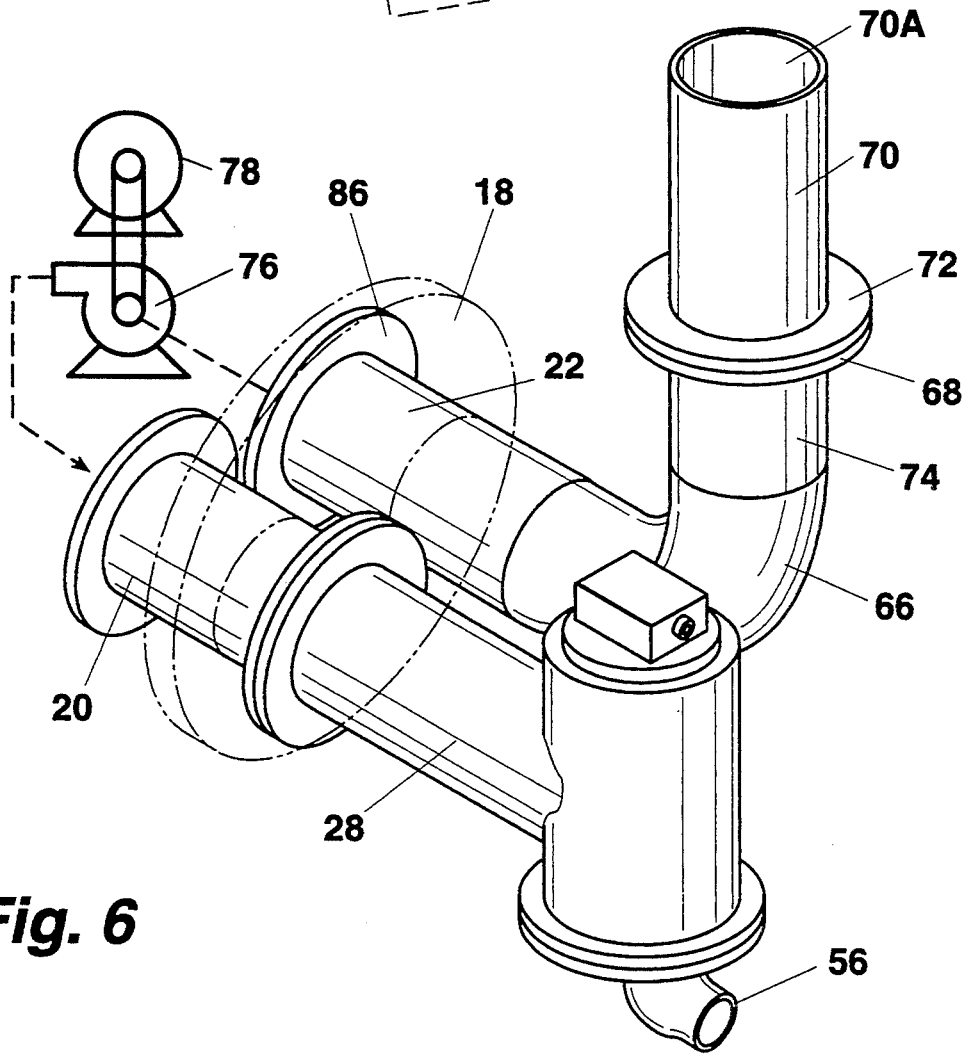
FIG. 6 is a partial isometric view showing the means of mounting the structure of FIG. 1 to a plate that is secured to a tank manhole.

Positioned in plate 18 and spaced apart side-by-side in paralleled relationship is horizontal tubular inlet 20 and tubular outlet member 22. In the embodiment of FIGS. 1 and 6, tubular inlet member 20 has an exterior flange 24 and interior flange 26. Flanges 24 and 26 provide means for attachment of additional piping members as will be described.

Affixed to inlet pipe 20 is a horizontal tubular member 28 having a flange 30 that is secured to flange 26. Supported at the inner end 32 is a vertical outer casing 34 having an upper end 34A and lower end 34B, the lower end being supplied with a flange.

Figure 3:
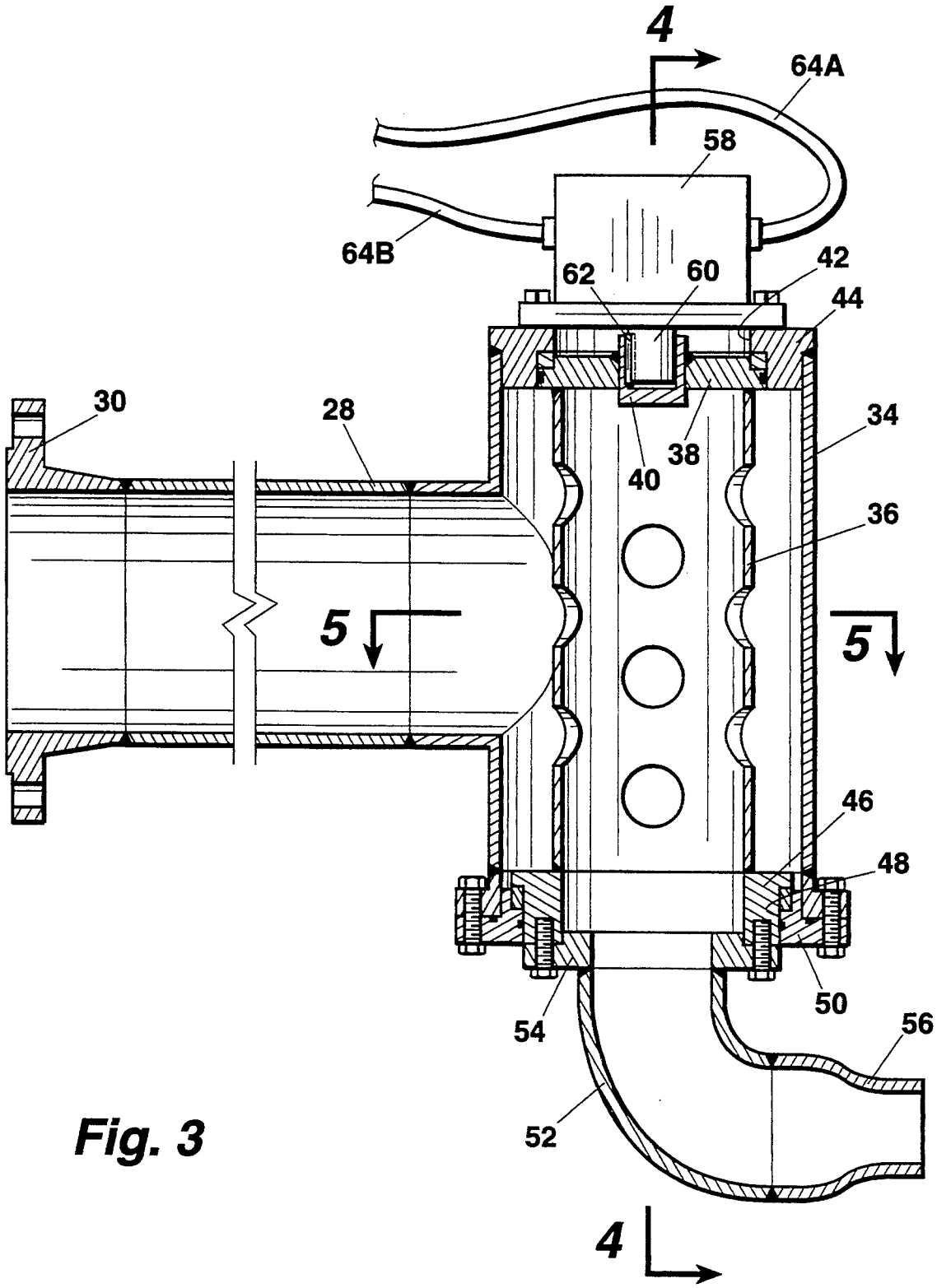
FIG. 3 is an enlarged elevational cross-sectional view of the major components employed interiorly of the tank as used in practicing the system of this invention.
Figure 4:
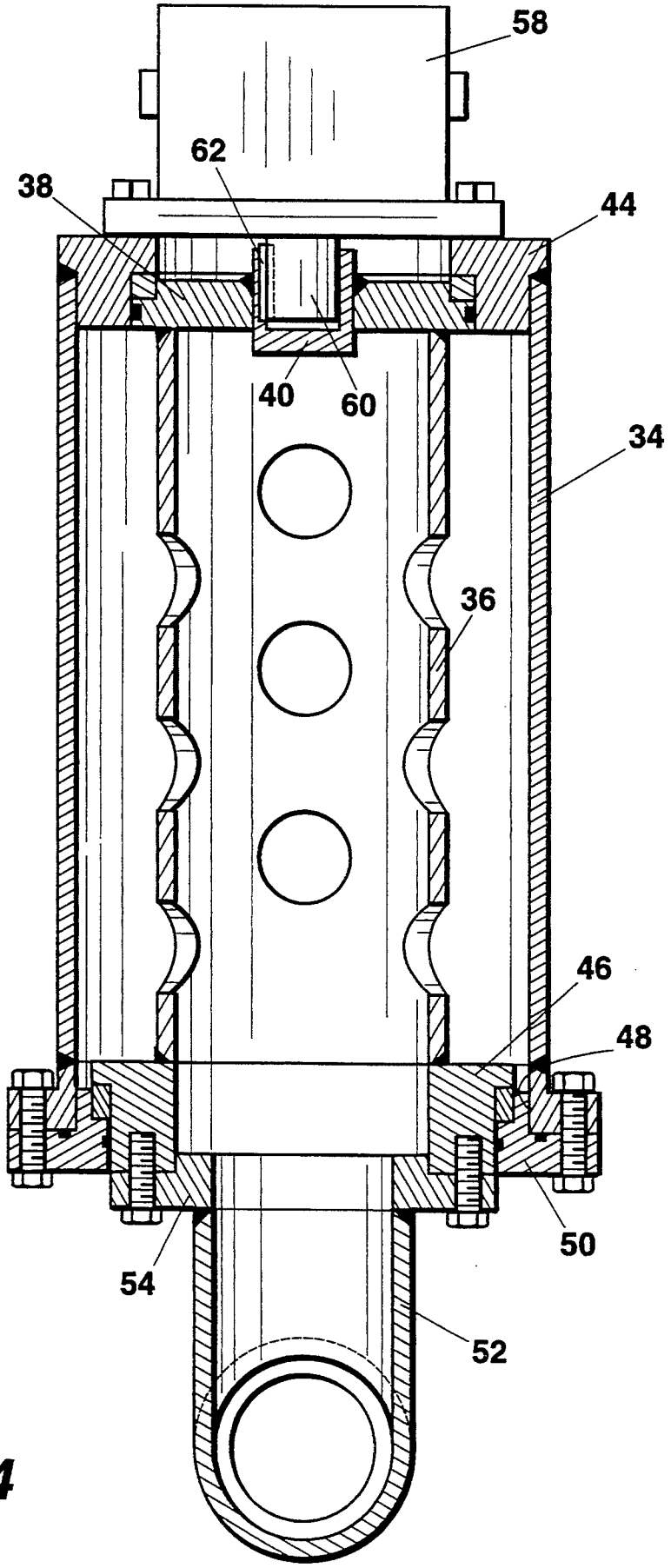
FIG. 4 is an enlarged elevational cross-sectional view as taken along the line 4—4 of FIG. 3 showing the vertical outer casing and perforated inner casing in cross-section and showing the stepping motor mounted at the top of the outer casing.
Figure 5:
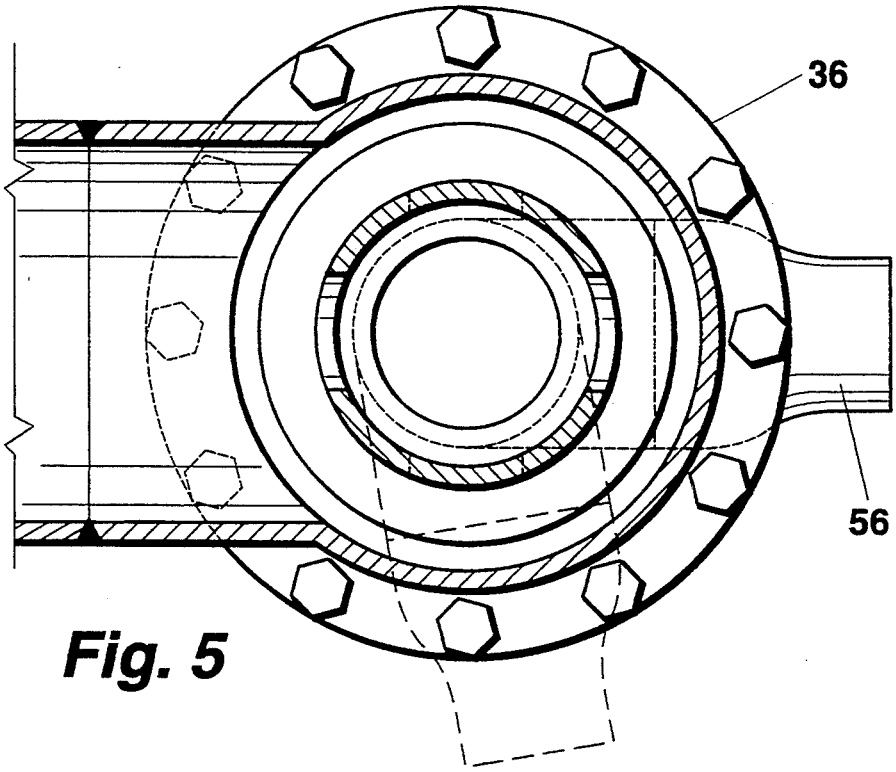
FIG. 5 is a fragmentary horizontal cross-sectional view taken along the line 5—5 of FIG. 3 showing more details of the relationship between the horizontal tubular member, the vertically supported outer casing, the perforated inner casing and the nozzle as used in the system of this invention.

Rotatably supported within vertical outer casing 34 is a perforated inner casing 36 (best seen in FIGS. 3 and 5). Secured to the upper end of inner casing 36 is plate 38 having a concentric socket 40. Plate 38 rotates within opening 42. An upper plate 44 is secured to the upper end of outer casing 34.

At the lower end of perforated inner casing 36 is a tubular lower plate member 46 that rotates within opening 48 in an outer casing tubular plate 50.

Secured to the tubular plate 50 is elbow 52 which may be accomplished by the use of a flange 54, and affixed to elbow 52 is an open-ended nozzle 56. Thus, it can be seen that nozzle 56 extends in a horizontal direction that is parallel to tank bottom 12 and is rotated as inner casing 36 is rotated (best seen in FIG. 1).

Affixed to upper plate 44 of vertical outer casing 34 is stepping motor 58. Extending downwardly from stepping motor 58 is shaft 60 that is received in socket 40, key 62 is employed to rotatably lock shaft 60 to socket 40 and to thereby lock the rotation of perforated inner casing 36 to shaft 60.

Stepping motor 58 may be electrically activated by use of an electrical cable extending through the tank sidewall and controlled by circuitry external of the tank. A preferred means as illustrated employs a hydraulically actuated stepping motor with hydraulic fluid being supplied by conduits 64A and 64B. One type of hydraulic stepping motor 58 that can be used in practice of this invention is the type that uses a rack and pinion, wherein the rack is displaced by fluid acting on one or more hydraulic cylinders. A commercially available example of such product is available from the rotary actuator division of Parker Fluid Power Company of Wadsworth, Ohio and is referred to by this company as a "Hydraulic Rack and Pinion Rotary Actuator". In any event, in response to hydraulic fluid, stepping motor 58 incrementally rotationally advances shaft 60 to thereby rotationally incrementally position nozzle 56.

Figure 2:
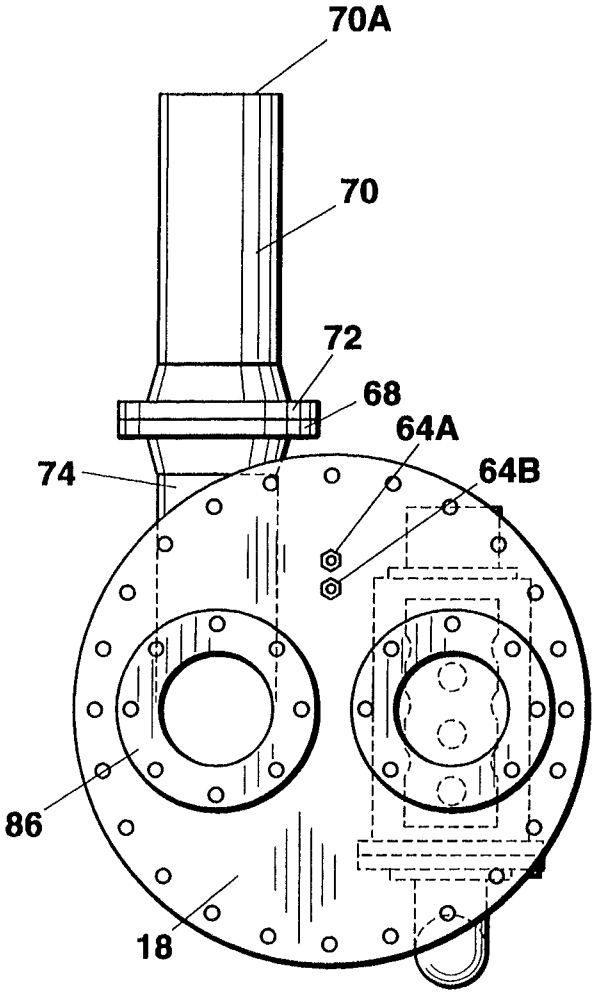
FIG. 2 is an elevational view taken along the line 2—2 of FIG. 1 showing the mechanism of the sediment removal system and without showing the tank structure so as to show more details of the apparatus used in the system.

As shown in FIG. 2, the hydraulic conduit 64A and 64B extends sealably through plate 38 to the exterior of vessel 10.

As previously stated, fluid from the interior of tank 10 is injected outwardly through nozzle 56. Fluid is withdrawn from tank 10 by means of outlet pipe 22 as previously described, the outlet pipe and the portions of the system attached to it are best seen in FIGS. 1, 2 and 6. The outlet pipe 22 receives elbow 66 that turns upwardly and has flange 68. Attached by flange 72 to flange 68 is an open ended tubular extension 70. A tubular extension 74 is employed between elbow 66 and flange 68 to space the open end 70A of inlet pipe 70 a selected distance from the tank bottom 12.

As shown diagrammatically in FIG. 6, pump 76 is mounted exterior of tank 10 and may be motor or engine driven, a motor being indicated by the numeral 78. Fluid is withdrawn through outlet pipe 22 to pump 76 and injected back into the interior of the vessel through inlet pipe 20 for ultimate ejection through nozzle 56 to sweep a jet of fluid above the tank floor to loosen and re-suspend the sediments in the fluid.

Figure 9:
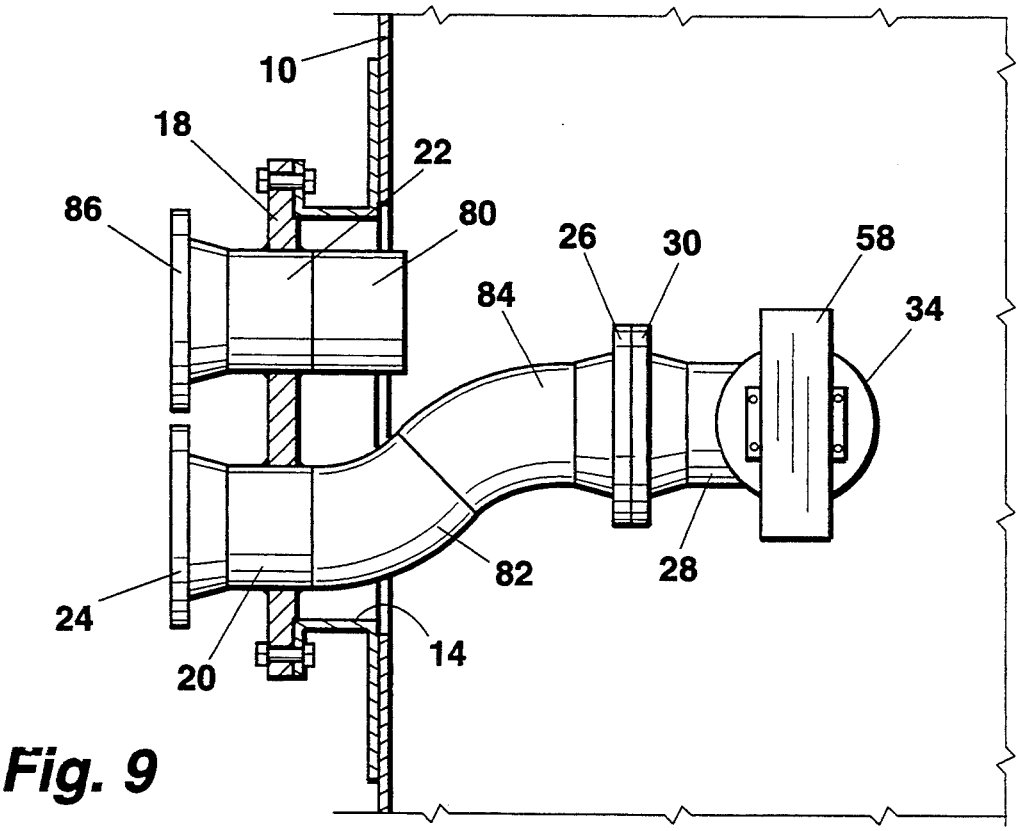
FIG. 9 is a horizontal view as taken along the line 9—9 of FIG. 8 showing the relationship between the fluid inlet and outlet sections of the apparatus.
Figure 8:
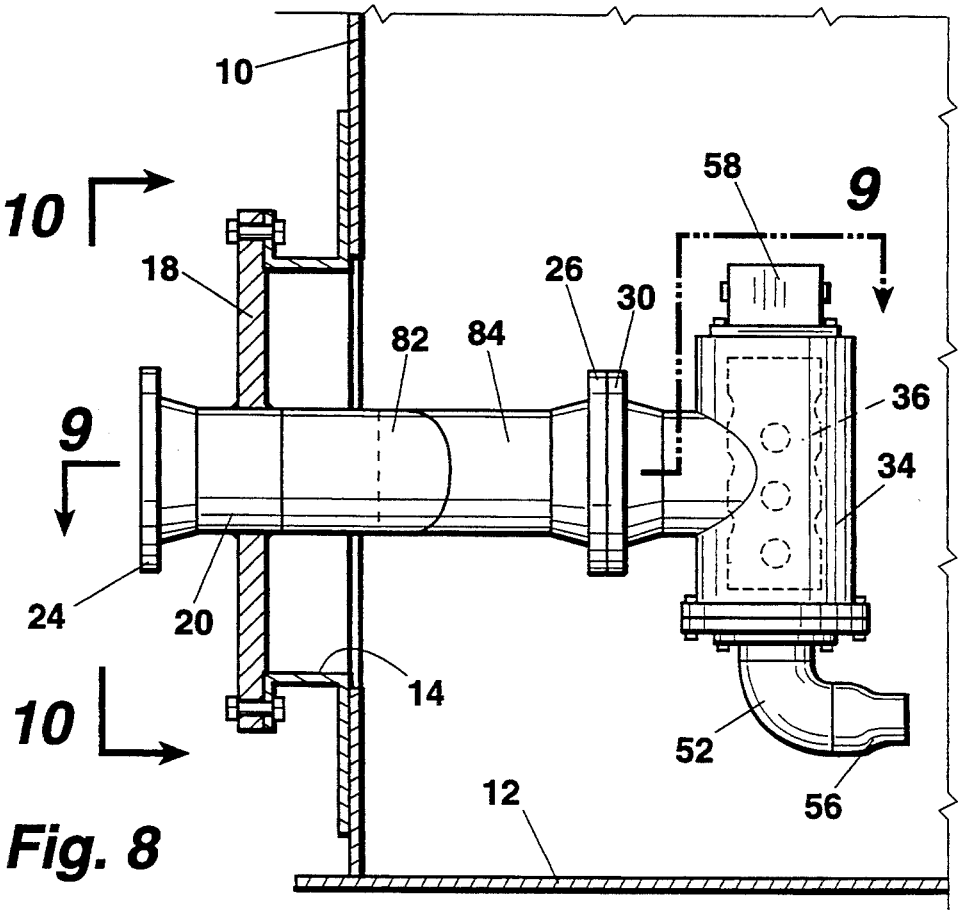
FIG. 8 shows an alternate arrangement for supporting the fluid inlet and outlet sections, the inlet section serving to discharge fluid through the rotated nozzle while the outlet section provides means for withdrawing fluid from the interior of the vessel.
Figure 10:
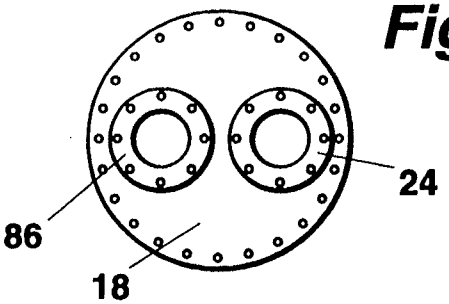
FIG. 10 is an elevational exterior view as taken along 10—10 of FIG. 8 showing a manhole cover plate with a fluid inlet and outlet conduit supported in the plate.
Figure 11:
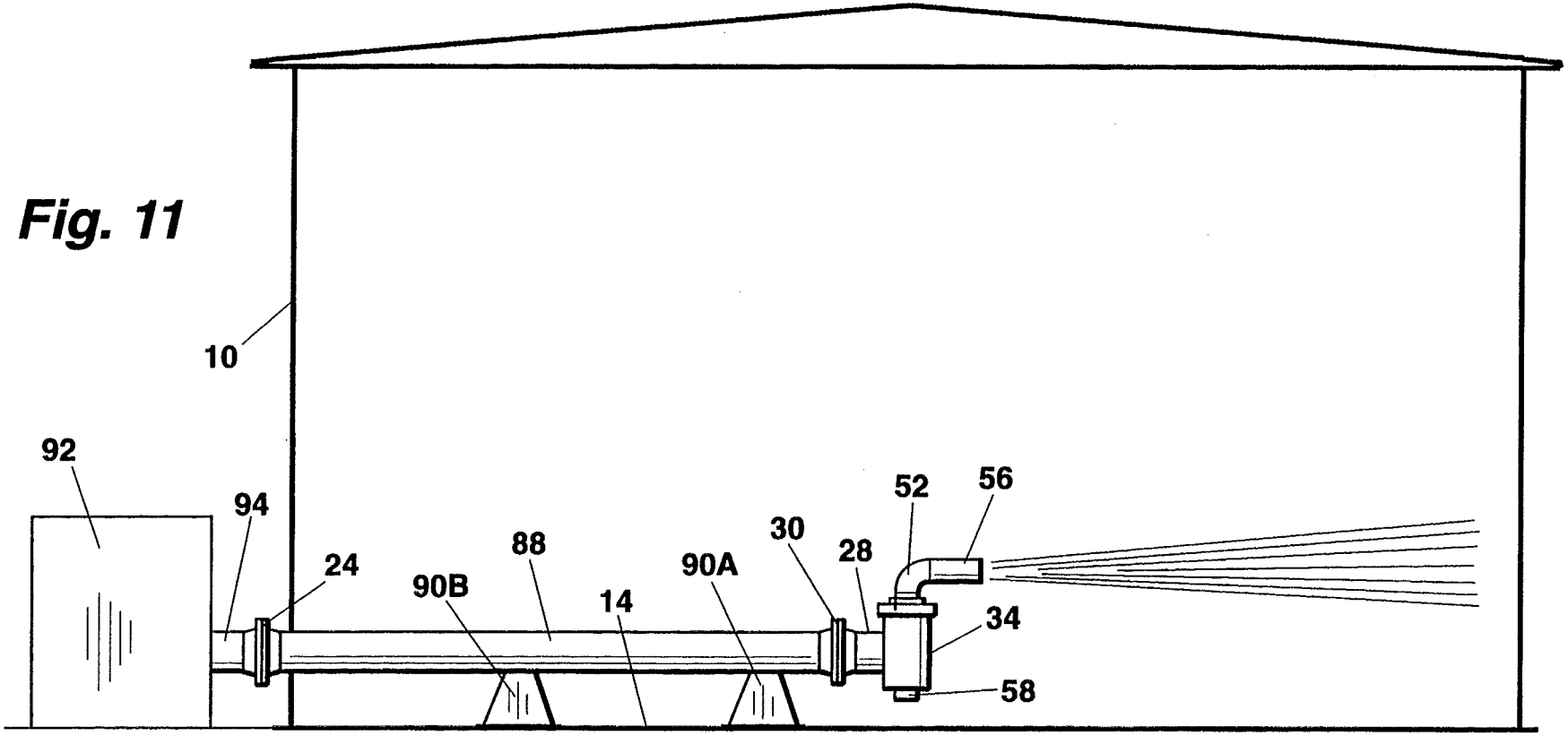
FIG. 11 is a reduced scale elevational view showing an alternate means of mounting the sludge removal system which permits the system to be positioned substantially centrally of the interior of a cylindrical tank with the horizontal tubular support member supported on the tank floor rather than being supported entirely by a plate affixed to a manhole as illustrated in FIGS. 1–6 and 8–10.

FIGS. 8, 9 and 10 show an alternate means of supporting the components making up the sludge removal system wherein the function is exactly the same except for the slight changes in piping. The main difference in the embodiment of FIGS. 8, 9 and 10 is that outlet pipe 22, as received in plate 18, is provided only with a short open-ended extension 80. To more centrally position the mechanism which supports and actuates the nozzle, angular bends 82 and 84 extend from inlet pipe 20 to flange 26 so that the horizontal tubular member 28 is supported more or less in direct alignment with plate 18. The arrangement of FIGS. 8, 9 and 10 simplify the installation and removal of the sludge removal system for repair and maintenance, however, the principal of operation of the arrangements of FIGS. 8, 9 and 10 is exactly the same as that described with reference to FIGS. 1–6.

As shown in FIGS. 2, 6, 9 and 10, outlet pipe 22 has an exterior flange 86 that is adjacent to and parallel to inlet pipe exterior flange 24 to provide convenience for connection to the pump system as employed in the invention and as illustrated diagrammatically in FIG. 6.

Referring to FIG. 11, an alternate method of practicing the invention is shown. Tank sidewall 10 and bottom 14 are illustrated as previously referenced. The tank is shown with a fixed roof, however, this is by way of example only as large diameter crude oil storage tanks frequently employ floating roofs. In this embodiment, the vertical outer casing 34, that rotatably supports elbow 52, and nozzle 56 are positioned adjacent to the circumferential center of tank sidewall 10. In the embodiment of FIG. 11, nozzle 56 is placed at the top end of vertical outer casing 34 with stepping motor 58 positioned at the bottom end. This is arbitrary as the nozzle can be placed at the top or bottom either in the embodiment previously described or that in FIG. 11. The primary difference in the embodiment of FIG. 11 is that the structure is not supported from a plate secured to a manhole but is supported by a horizontal pipe 88 off of the tank floor 14 by means of pipe supports 90A and 90B. Pipe 88 extends sealably through the wall of the tank and is provided with an outer flange 24, as previously described, by which a pumping system may be connected to it. In the embodiment of FIG. 11 the pumping system is contained within an enclosure 92 having an outlet pipe 94. A fluid outlet system is required for the arrangement of FIG. 11 the same as with the previously described arrangement but is not illustrated. The fluid outlet system may be in the form of a short length tubular extension, such as extension 80 shown in FIG. 9 and therefore hidden from view in FIG. 11. The particularly selected fluid outlet is the option of the operator and is not dependent upon whether the system of FIG. 11 or the previously described systems are employed.

The advantages of the system of FIG. 11 is that it places nozzle 56 in the center of the tank so that the jet action can be equally spread over the entire circumference of the tank for a more effective and thorough sediment removal action. A disadvantage of the system of FIG. 11 is that the system more frequently requires personnel to enter the interior of the tank.

Figure 7:
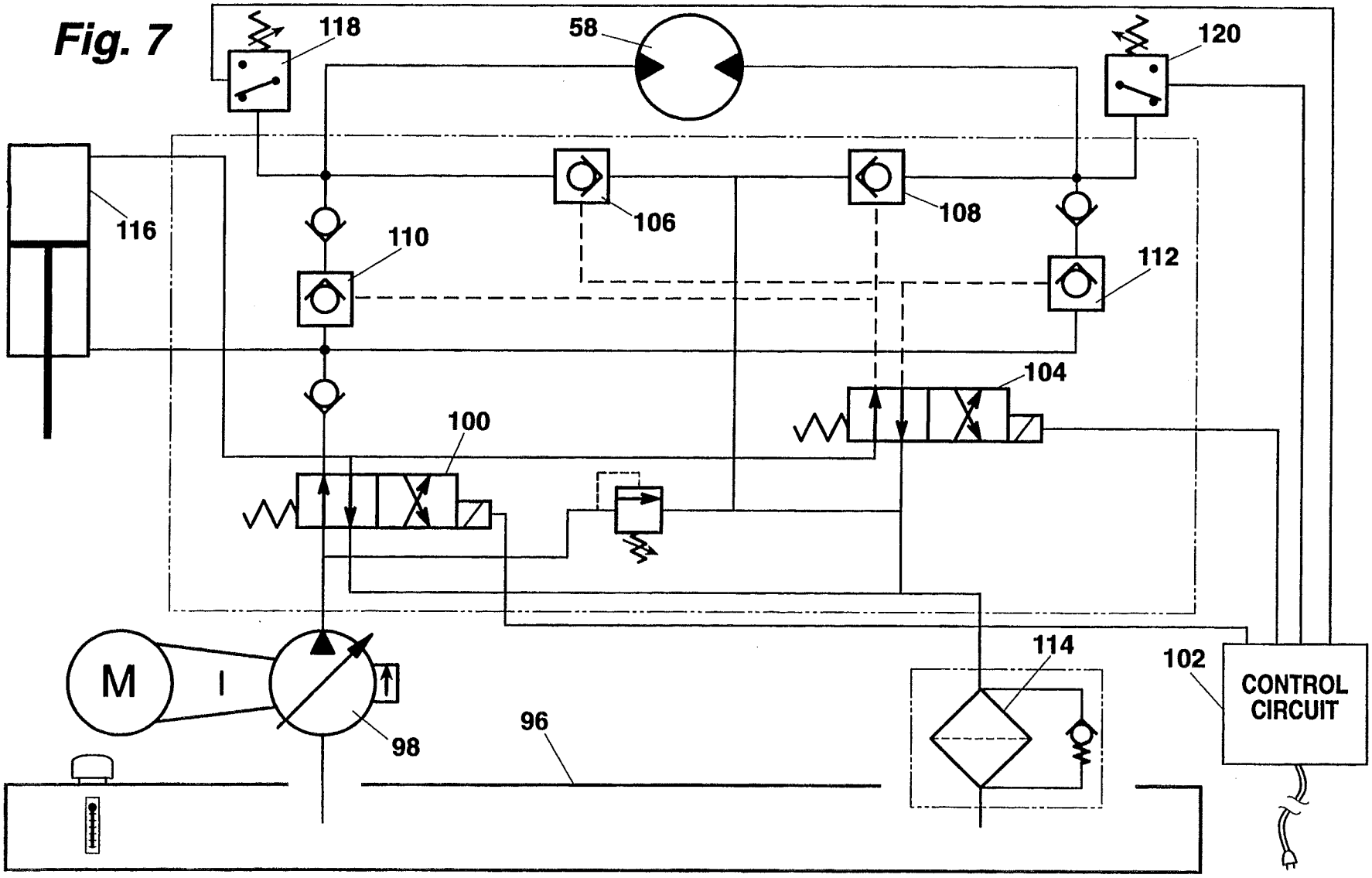
FIG. 7 is a hydraulic schematic showing an example of the schematic controls which may be employed for operation of the stepping motor by which the position of the nozzle can be stepped in increments to sweep substantially the entire tank bottom.

FIG. 7 shows a hydraulic schematic that can be used in practicing the invention. The schematic of FIG. 7 is representative only since the control of stepping motor 58, whether electric or hydraulic, can be practiced in a number of ways. FIG. 7 however illustrates one embodiment for providing hydraulic fluid to the stepping motor when it is hydraulically actuated, that is, when it is, as an example, of a cylindrical actuated rack and pinion arrangement. Tank 96 provides a source of hydraulic fluid. Hydraulic pressure is supplied by a variable volume piston pump 98. The direct flow of the hydraulic pressure is channelled by a solenoid operated direction control valve 100 in response to electrical signals supplied from a control circuit 102. The direction of fluid flow to the hydraulic rack and pinion rotary actuator 58 is controlled by means of a second solenoid operated direction control valve 104 which in turn is controlled by circuitry 102. Control valve 104 controls the actuation of pilot operated check valves 106, 108, 110 and 112 to direct the fluid flow to stepping motor 58. The flow of fluid ultimately returns through a filter 114 to tank 96. The quantity of fluid flow is channelled through a hydraulic cylinder 116 which can be utilized to apply limits on fluid flow to thereby determine the quantity of fluid passed to motor 58. Pressure actuated switches 118 and 120 provide signals to control circuit 102 for use in determining the signals to be applied to control valves 100 and 104.

As previously stated, the hydraulic arrangement of FIG. 7 is by way of example only as the stepping motor can be controlled externally of the tank in a variety of ways to produce incremental flows of hydraulic fluid to the stepping motor to advance the stepping motor output shaft in selectable increments of rotation and with the time delay for each incremented stepped position of the stepping motor shaft determined by timing signals provided by control circuit 102. In this way, the operator has full control over the method of use of the sludge removal system to adapt it to changing conditions and to the degree of sludge removal required for changing circumstances.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A system for removing sludge from the horizontal bottom of a tank having liquid stored therein which comprises:

a body member;

a casing rotatable with respect to said body member and provided with a horizontally extending nozzle arranged so that liquid discharged therefrom sweeps substantially in a plane above said tank bottom;

means to recycle liquid from said tank and back through said body member, said casing and said nozzle;

a stepping motor for rotating said casing with respect to said body member; and means externally of said tank to control said stepping motor.

2. A system for removing sludge from the bottom of a tank according to claim 1 wherein said stepping motor is stepped in selectable angular increments.

3. A system for removing sludge from the bottom of a tank according to claim 2 wherein the time between each step at said stepping motor is selectable.

4. A system for removing sludge from the bottom of a storage tank according to claim 1 wherein said body member is supported by a horizontal tubular member extending from a sidewall of said tank.

5. A system for removing sludge from the bottom of a storage tank according to claim 1 wherein said means to control said stepping motor includes hydraulic means.

6. A system for removing sludge from the bottom of a storage tank according to claim 5 wherein said hydraulic means includes:

a source of hydraulic fluid;

a motor driven pump connected to said source of hydraulic fluid providing a pressurized fluid source;

fluid flow directing means in series with said pressurized fluid source, said source of hydraulic fluid, said motor driven pump and said fluid flow directing means being external of said storage tank; and a pair of conduits extending through a wall of said tank connecting said fluid flow directing means and said stepping motor.

7. A system for removing sludge from the bottom of a storage tank according to claim 1 wherein said tank has a cylindrical sidewall and wherein said body member is positioned substantially at the center of said cylindrical sidewall.

8. Sludge removing system for stirring and reducing the build up of bottom sediments in a storage tank, the tank having a sidewall and a horizontal bottom, comprising:

a horizontal tubular member supported within said tank and spaced above said tank bottom and having an inner end and an outer end communicating with the exterior of said tank;

a vertical outer casing having a top and a bottom end and an intermediate opening communicating with said tubular member inner end;

a perforated inner casing positioned concentrically within said outer casing and having an upper and a lower end;

means for rotatably supporting said inner casing within said outer casing;

an elbow fitting affixed to said inner casing at one of said upper and lower ends;

a nozzle affixed to said elbow fitting having an outlet directed to discharge fluid over said tank bottom;

a stepping motor secured to said outer casing and having an output shaft affixed to said inner casing by which said inner casing and thereby said nozzle is rotated;

means to circulate fluid from out of the interior of said tank back through said horizontal tubular member, through said perforated inner casing to produce a jet of fluid out through said nozzle to stir said bottom sediments; and means to control said stepping motor to rotate said inner casing and thereby said nozzle to sweep said jet of fluid over substantially the entirety of said tank horizontal bottom.

9. A system for removing sludge from the bottom of a storage tank according to claim 8 wherein said means to control said stepping motor includes hydraulic means.

10. A system for removing sludge from the bottom of a storage tank according to claim 9 wherein said hydraulic means includes:

a source of hydraulic fluid;

a motor driven pump connected to said source of hydraulic fluid providing a pressurized fluid source;

fluid flow directing means in series with said pressurized fluid source, said source of hydraulic fluid, said motor driven pump and said fluid flow directing means being external of said storage tank; and a pair of conduits extending through a wall of said tank connecting said fluid flow directing means and said stepping motor.

11. A system for removing sludge from the bottom of a storage tank according to claim 8 wherein said tank has a cylindrical sidewall and wherein said body member is positioned substantially at the center of said cylindrical sidewall.

12. A system for removing sludge from the bottom of a tank according to claim 8 wherein said stepping motor is stepped in selectable angular increments.

13. A system for removing sludge from the bottom of a tank according to claim 12 wherein the time between each step at said stepping motor is selectable.

14. A system for removing sludge from the bottom of a storage tank according to claim 8 wherein said body member is supported by a horizontal tubular member extending from a sidewall of said tank.

* * * * *